US005934784A

United States Patent [19]

Dion

[11] Patent Number: 5,934,784

[45] **Date of Patent: *Aug. 10, 1999**

[54] ILLUMINATED ARTICLE OF APPAREL

[76] Inventor: Larry Dion, 712 Upsal Rd., Rydal, Pa. 19046

[ * ] Notice: This patent is subject to a terminal disclaimer.

[21] Appl. No.: 09/069,399

[22] Filed: Apr. 29, 1998

Related U.S. Application Data

[63] Continuation of application No. 08/682,046, Jul. 16, 1996, which is a continuation of application No. 08/471,783, Jun. 6, 1995, Pat. No. 5,649,758, which is a division of application No. 08/166,518, Dec. 13, 1993, Pat. No. 5,438,488.

[51] Int. Cl.[6] ..... A45D 8/00

[52] U.S. Cl. ..... 362/103; 362/104; 362/276; 362/802; 362/191; 362/196; 362/800

[58] Field of Search ..... 362/103, 184, 362/104, 800, 190, 191, 198, 276, 802, 196; 473/570, 576; 36/136, 137; 2/245

[56] References Cited

U.S. PATENT DOCUMENTS

| | | | |
|---|---|---|---|
| D. 182,102 | 2/1958 | Behr | D86/10 |
| D. 335,019 | 4/1993 | Allen | D2/315 |
| 1,184,396 | 5/1916 | Trimble . | |
| 2,020,484 | 11/1935 | Turner . | |
| 2,149,170 | 2/1939 | Gould | 2/68 |
| 2,546,945 | 3/1951 | Gaffield . | |
| 2,572,760 | 10/1951 | Rikelman | 36/1 |
| 2,670,570 | 2/1954 | Gnaizda | 46/172 |
| 2,724,769 | 11/1955 | D'Arbeloff . | |
| 2,798,148 | 7/1957 | Di Lizio et al. . | |
| 3,211,160 | 10/1965 | Miller | 132/47 |
| 3,441,032 | 4/1969 | Barrett | 132/46 |
| 3,450,872 | 6/1969 | Aiello, Jr. | 240/59 |
| 3,501,628 | 3/1970 | Madden . | |
| 3,549,878 | 12/1970 | Bailey . | |
| 3,564,583 | 2/1971 | Klugmann . | |
| 3,675,005 | 7/1972 | Curiel . | |
| 3,751,769 | 8/1973 | Reiner | 24/73 |
| 3,758,771 | 9/1973 | Frohardt et al. . | |
| 3,766,376 | 10/1973 | Sadacca et al. . | |
| 3,866,035 | 2/1975 | Richey, Jr. | 240/6.4 |
| 3,984,674 | 10/1976 | Guetta . | |
| 4,002,893 | 1/1977 | Newcomb et al. . | |
| 4,009,381 | 2/1977 | Schreiber et al. . | |
| 4,173,035 | 10/1979 | Hoyt | 362/249 |
| 4,296,459 | 10/1981 | DeLuca | 362/104 |
| 4,597,198 | 7/1986 | Schweitzer | 36/100 |
| 4,604,760 | 8/1986 | Coin | 2/209 |
| 4,611,416 | 9/1986 | Lin | 36/136 |
| 4,719,544 | 1/1988 | Smith | 362/104 |
| 4,748,366 | 5/1988 | Taylor | 310/328 |
| 4,779,172 | 10/1988 | Jimenez et al. | 362/104 |
| 4,812,953 | 3/1989 | Ask et al. | 362/103 |
| 4,848,009 | 7/1989 | Rodgers | 36/137 |
| 4,903,176 | 2/1990 | Chen | 362/103 |
| 4,912,944 | 4/1990 | Crosley et al. | 132/275 |
| 4,930,052 | 5/1990 | Beige | 362/104 |
| 4,998,186 | 3/1991 | Cocca | 362/103 |
| 5,036,442 | 7/1991 | Brown | 362/800 |
| 5,054,778 | 10/1991 | Maleyko | 273/58 |
| 5,081,568 | 1/1992 | Dong et al. | 362/800 |
| 5,128,843 | 7/1992 | Guritz | 362/103 |
| 5,186,458 | 2/1993 | Redondo | 273/65 |
| 5,188,447 | 2/1993 | Chiang et al. | 362/103 |
| 5,209,000 | 5/1993 | Rowland et al. | 36/136 |
| 5,236,383 | 8/1993 | Connelly | 446/219 |
| 5,649,758 | 7/1997 | Dion | 362/103 |

*Primary Examiner*—Thomas M. Sember
*Attorney, Agent, or Firm*—Duane Morris & Heckscher LLP

[57] ABSTRACT

An intermittently illuminated article of apparel which includes a light source and a flasher connected to the light source. The flasher may include a pulse generator, which, in turn, may further include a digital oscillator for generating sequential pulses of voltage, which are supplied to the light source. The article further includes a battery holder connected to the flasher for holding a battery, and a ball mountable on the hair of a wearer by an elastic member connected thereto. This ball may be made in two separable and reassemblable sections, to provide ready access to the interior thereof as needed. These sections may be configured so that they can be snapped together and pulled apart readily by the user.

25 Claims, 7 Drawing Sheets

ILLUMINATED ARTICLE OF APPAREL

CROSS REFERENCE TO RELATED APPLICATION

This application is a continuation of U.S. patent application Ser. No. 08/682,046 filed Jul. 16, 1996, which is a continuation of U.S. patent application Ser. No. 08/471,783, filed Jun. 6, 1995, now U.S. Pat. No. 5,649,758, which is a division of U.S. patent application Ser. No. 08/166,518, filed Dec. 13, 1993, now U.S. Pat. No. 5,438,488.

FIELD OF THE INVENTION

This invention relates to apparel items, such as arm/hand bracelets, sneakers, earrings, hair ties, and the like, which include illuminated displays, and especially an illuminated strip displays that blink on and off.

BACKGROUND OF THE INVENTION

Articles of apparel are known which are illuminated in various ways for purposes of aesthetic effect, safety or as a novelty. Thus, for examples, earrings, wigs, jewelry and shoes have been provided with sources of illumination for such purposes. In some cases, light-emitting diodes have been used as the sources of the illumination, and it is also known to turn such light-emitting diodes on and off in response to motion of the body on which they are carried.

The present invention provides other, and novel, illuminated articles of apparel which present unique appearances, and are also easy and inexpensive to fabricate and use.

SUMMARY OF THE INVENTION

In accordance with the preferred embodiments of this invention, there is provided an intermittently illuminated article of apparel which includes a light source, a flasher connected to the light source. The article further includes a battery holder connected to the flasher for holding a battery, and support means mountable on the hair of a wearer by an elastic member connected thereto, the support means supporting the light source.

The flasher may further include a pulse generator. This pulse generator may further include a digital oscillator for generating sequential pulses of voltage, and means for supplying the pulses of voltage to the light source.

In a preferred embodiment, the support means comprises a ball in which the flasher is mounted, and having attachment means for securing it to an elastic band. This ball may be made in two separable and reassemblable sections, to provide ready access to the interior thereof as needed. These sections may be configured so that they can be snapped together and pulled apart readily by the user.

BRIEF DESCRIPTION OF THE DRAWINGS

These and other objects and features of the invention will be more readily understood from a consideration of the following detailed description, taken with the accompanying drawings, in which corresponding parts are indicated by corresponding numerals and in which.

DETAILED DESCRIPTION OF THE INVENTION

Figure 1:
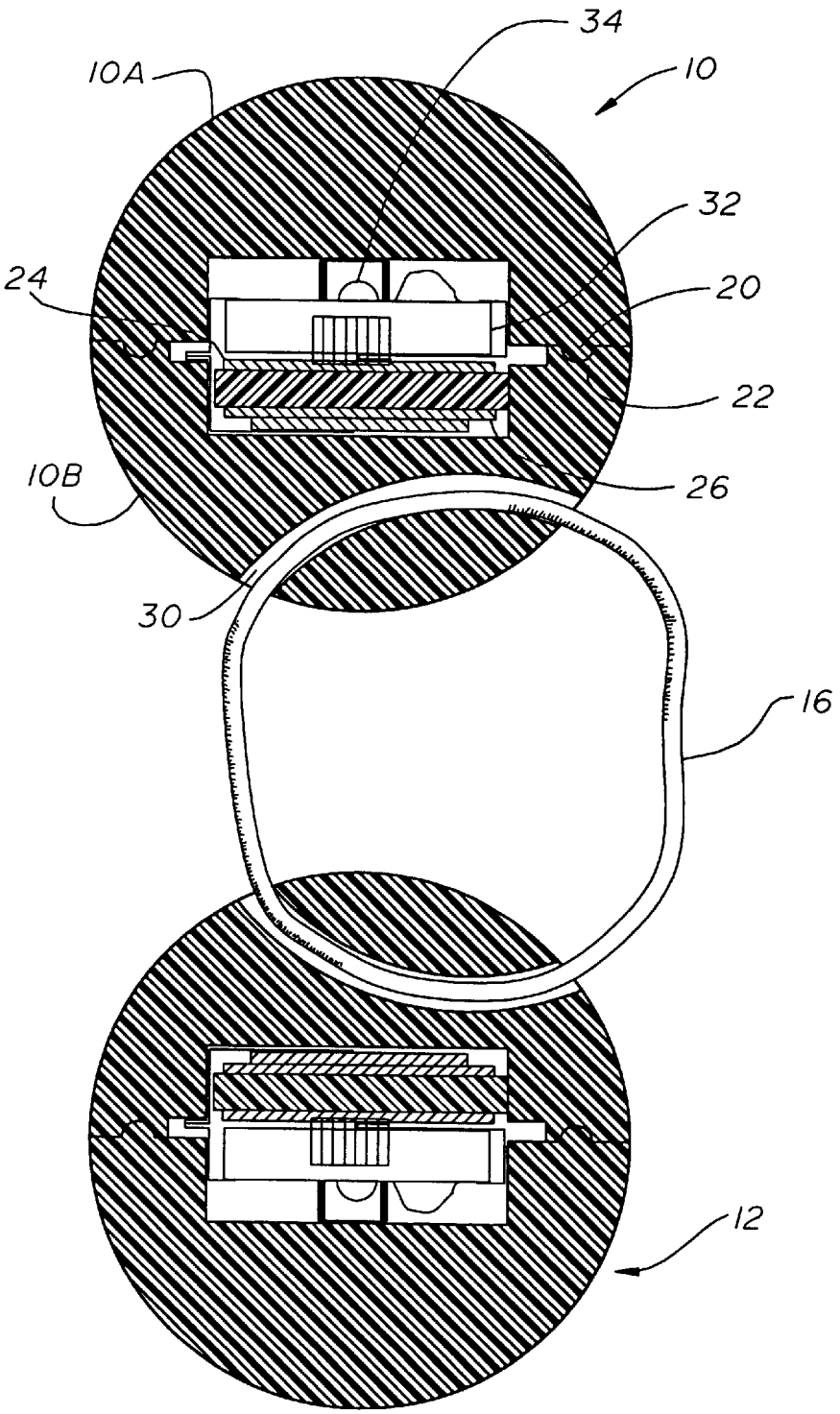
FIG. 1 is a sectional view of one preferred embodiment of the invention using a pair of intermittently illuminated hollow balls or shells joined by an elastic band, for use in the hair.
Figure 2:
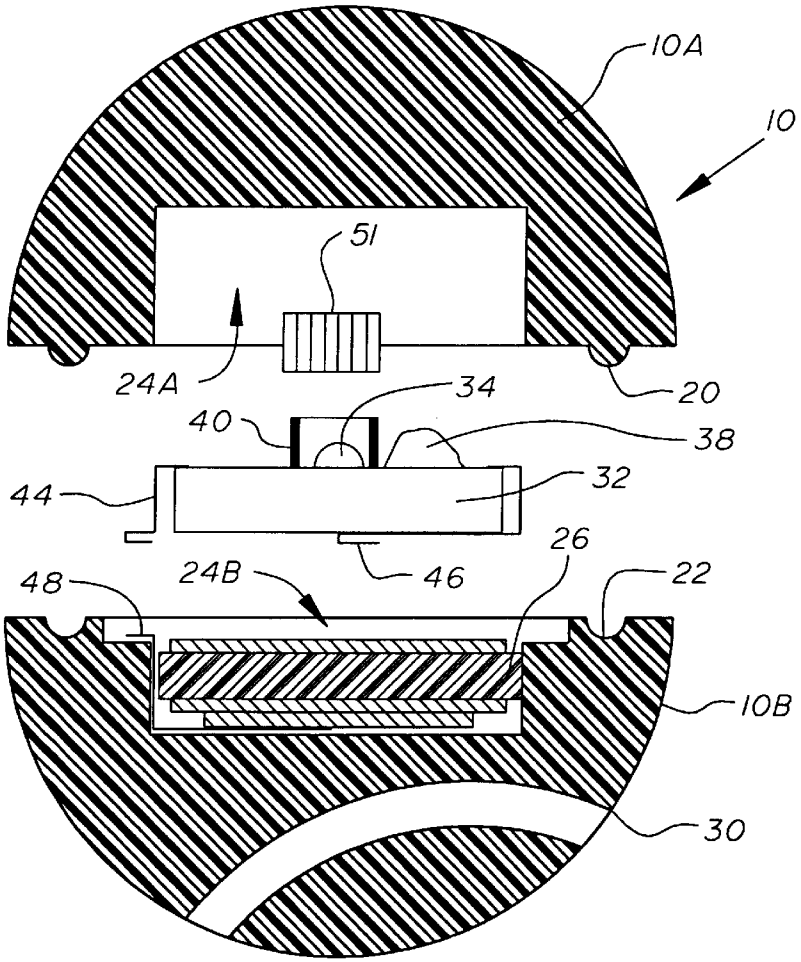
FIG. 2 is an enlarged sectional view of one of the balls or shells of FIG. 1, in exploded form with its two halves separated.
Figure 3:
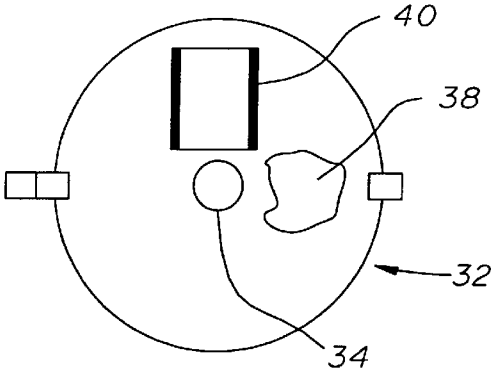
FIG. 3 is a top view of a circuit board of one of the balls of FIG. 1.
Figure 4:
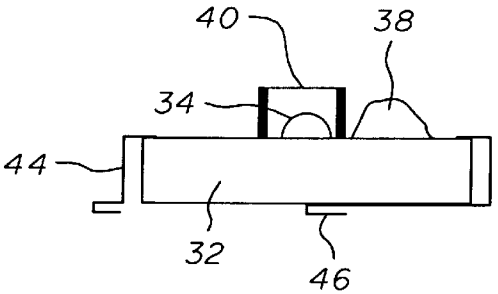
FIG. 4 is a side elevational view of the printed circuit board assembly used in the balls of FIG. 1.

U.S. Pat. No. 5,649,758, issued Jul. 22, 1997, is incorporated by reference herein in its entirety. Turning now to the embodiments of the invention represented in the drawings and without thereby in any way limiting the scope of the invention, FIGS. 1–7 show how the invention is preferably applied to ornamental flashing balls or shells such as 10 or 12 of FIG. 1, for use at each end of an elastic band 16 by which the assembly may be secured to the user's hair. The two balls are identical in this example, hence the details of only one ball will be discussed.

Ball 10 is made in two halves 10A and 10B, and protrusions such as 20 on half 10A mate with depressions such as 22 on the other half 10B, so that the two halves can be pressed together to secure them to each other, and readily pulled apart when access to the interior is desired. Facing cavities 24A, 24B (FIG. 2) are provided within the respective halves 10A and 10B of the ball, to form corresponding shells, such that when the two halves are placed together they define a single common opening 24 (FIG. 1).

The shell half 10B may have an integrated battery holder 11, which, in turn, holds a battery 26. A person skilled in the art will recognize that the battery holder 11 can be a separate element within the shell half 10B or the ball 10, or that the battery holder 11 can be disposed outside the ball 10.

The shell half 10B may also have a passage 30 through the ball provides means for securing the elastic band 16 to the shell by passing it through the passage.

The other shell-half 10A may have mounted thereon a small printed circuit board 32 which carries a light source, such as the light-emitting diode (LED) 34, the plastic-covered IC chip 38 for driving the LED, a large-valued capacitor 40, preferably utilized to produce a pulsing voltage larger than the terminal volts of the battery, a negative spring contact 44 and a positive spring contact 46 for the PC circuitry, to be connected respectively to the negative battery terminal and the positive terminal of the battery 26 within the battery holder 11. The negative contact clip 48 for the battery extends along the side of and above the battery, so as to be pressed against the corresponding negative contact 44 for the PC board assembly in the upper half of the shell; contact between the positive contact 46 of the upper half of the shell and the battery is made by the pressing of the latter positive contact against the top positive contact of the battery itself which occurs when the two shell halves are assembled to each other.

A person skilled in the art, however, will recognize that the LED 34 may be disposed on the outside of the shell 10. Similarly, a person skilled in the art will recognize that a plurality of LEDs may be installed instead of the LED 34. Further, such person may recognize that the plurality of LEDs may be disposed within or on the outside of the shell 10.

A person skilled in the art may also recognize that the printed board may be disposed outside shells 10 or 12.

The printed circuitry and circuit elements for the pulser are applied to the top of the printed circuit board 32 in the usual manner. An on/off switch 51 can be provided in the upper or lower shell half, either internally or externally, for manually turning off and on of the pulser. Alternatively, a motion switch can be used instead of a manual on-off switch. In a typical case, the IC chip may be a type LM 3909, and the complete ball may be from ¾" to ⅞" in diameter. The PC board may be of FR4 or G10 material, 15 mils thick, and circular with a 0.400" diameter.

Figure 5:
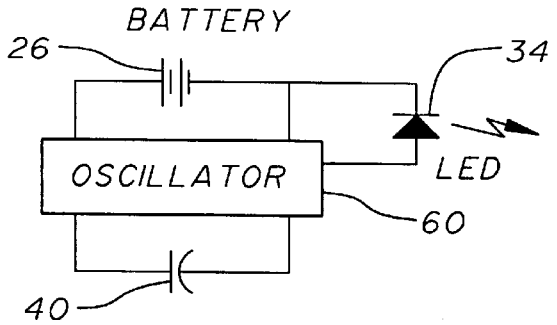
FIGS. 5, 6, and 7 are schematic electrical diagrams of circuits preferred for use in the ball of FIG. 1.

FIG. 5 shows in simplified form a typical driving circuit for the ball ornament of FIG. 1, consisting of an oscillator 60, the battery 26 and the LED 34; the capacitor 40 is also preferably used in conjunction with the oscillator as described below. The oscillator may be a conventional digital square-wave generator, and provides the timing and voltage to turn the LED on and off, typically at the rate of about 2 to 3 Hz. Power consumption of the driving circuit is very low, and the circuit preferably allows use of a small 1.35 volt battery to power the oscillator. More particularly, using an LED which requires 1.8 to 2 volts to turn it on, the oscillator 60, in combination with the capacitor 40, used in a known form of voltage-charging circuit, is able to provide pulses of up to 2 volts, so as to enable the turning on of the LED using only a 1.35 volt battery. A step charging circuit could additionally be employed to increase voltage. The electrolytic capacitor 40 may have a capacitance of 200 microfarads.

Figure 6:
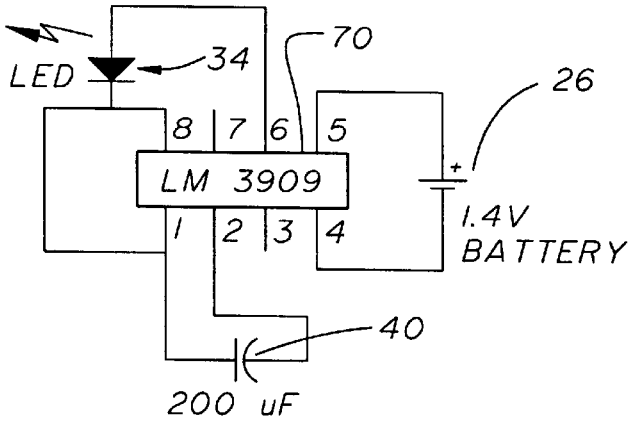

A typical circuit for driving the ball ornament of FIG. 1 is shown in more detail in FIG. 6, wherein the oscillator is embodied in an IC circuit 70, to which a capacitor 46 of 200 microfarad value is connected as a voltage-booster; the circuit uses an LED 34 powered by the 1.4 volt battery 24. The IC circuit may be a type LM 3909 made by National Semiconductor Co. This circuit was operable for 9.5 days of steady use, using a small hearing-aid button cell battery with a capacity of 90 milliampere hours.

Figure 7:
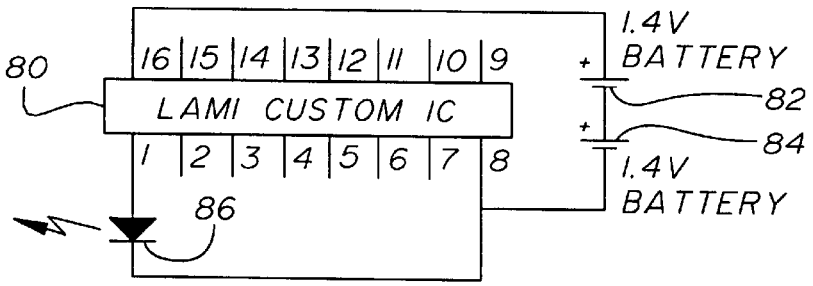

FIG. 7 shows another circuit for implementing the driving or pulsing of the ball ornament LED, using a custom integrated circuit 80 developed by LaMi Products, Inc., two 1.4 volt batteries 82, 84 and an LED 86.

It will be understood that any of a variety of other miniaturized digital current-pulsing circuits may be used for this purpose.

Figure 8:
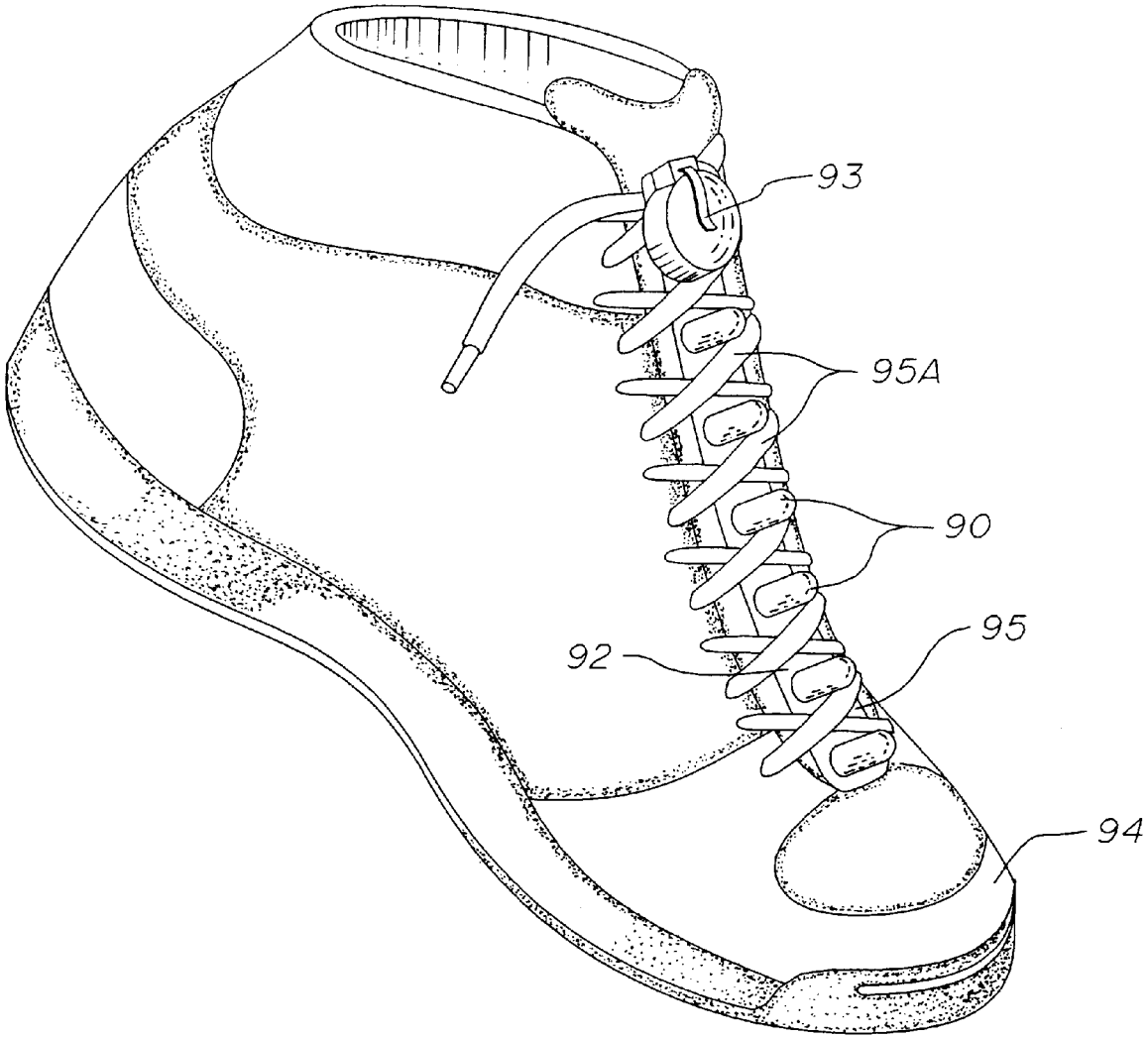
FIG. 8 is a perspective view showing another preferred embodiment of the invention installed in a shoe.
Figure 10:
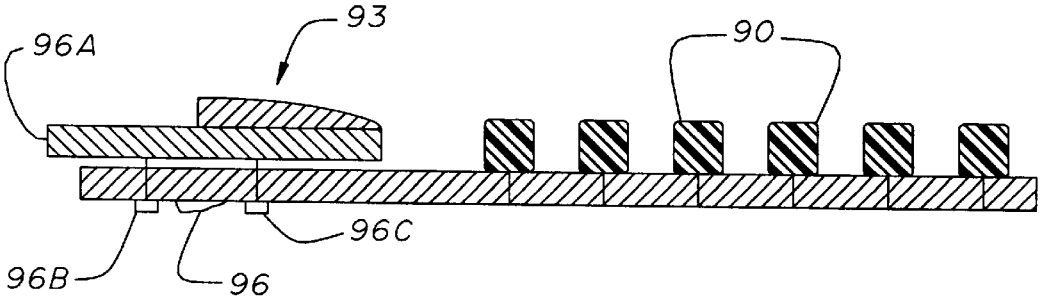
FIG. 10 is a vertical section through the strip of FIG. 9.

The remaining FIGS. 8–13 show another form of the invention and its operation, in which the LED's such as 90 are distributed in a linear array along an insulating, plastic strip 92, to one end of which is affixed the circuitry 93 for pulsing the LED's sequentially and repetitively, one after another; by way of separate wires leading to the separate LED's (not shown in FIG. 8). FIG. 8 illustrates how the array may be placed in a shoe 94, between the tongue 95 and the shoe's "fasteners", e.g. laces, VELCRO® straps or buckles. In the preferred embodiment of FIG. 8, the array is disposed between the crossed laces, such as 95A of an athletic shoe or sneaker, with the LED's 90 spaced apart by a distance such that the crossing laces do not obscure the LED's. In this example, which assumes six LED's, each is turned on in sequence so as to give an appearance of light traveling along the strip, as the LED's are successively turned on. The circuitry 93 preferably contains the pulse-forming IC 96, the one or more batteries 97 and battery holder 96A, the optional chip capacitor 96B and the optional chip resistor 96C as shown in FIG. 10.

Figure 11:
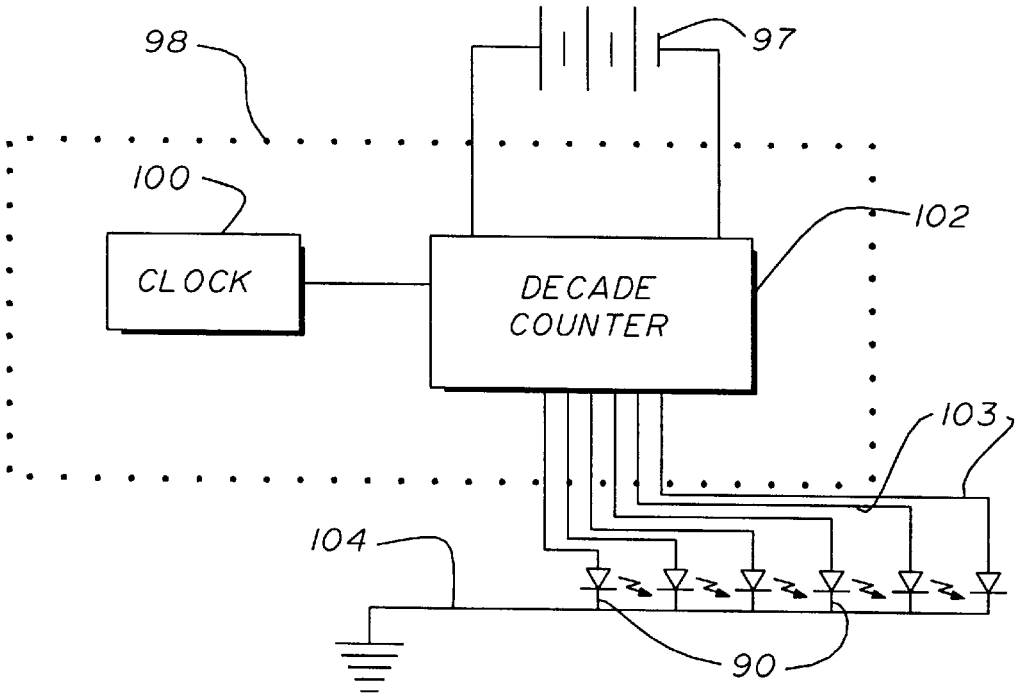
FIG. 11 is a schematic electrical diagram of a circuit for pulsing the light-emitting diodes in FIG. 9.

FIG. 11 shows in rather schematic form a typical circuit for driving such an arrangement. It employs a battery 97 connected to an LED driver 98 which consists of a clock 100 and a decade counter 102. The outputs (six in the example shown) of the decade counter are presented on seven separate leads such as 103, one for each of the LED's such as 90, the opposite sides of the LED's being connected to a common reference-potential line 104 such as ground. More particularly, the driver in this example utilizes a clock 100 which generates a square wave signal to trigger the decade counter 102, and the decade counter generates LED driver pulses at each of its output lines 103 in sequence, which are used to sequentially and repetitively turn on the corresponding respective LED's 90. In the preferred embodiment the clock and decade counter are on the same IC chip.

Figure 12:
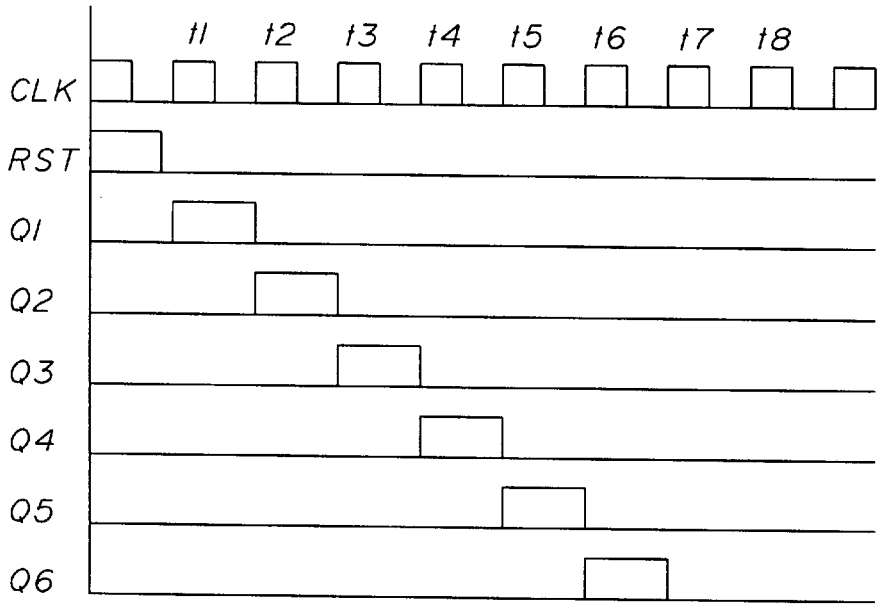
FIG. 12 is a timing diagram illustrating the voltage pulses used to pulse the light-emitting diodes in sequence in the embodiment of FIG. 1, as produced by the circuit of FIG. 11.

A preferred timing diagram for a unit like that of FIG. 11 is shown in FIG. 12, wherein time increases along the axis of abscissae and the several quantities listed vertically represent, from the top, the clock pulses CLK, a reset pulse RST, and the successive pulses Q1 to Q6 sent out sequentially by the decade counter to actuate the separate LED's. More particularly, in the top line of the graph is shown the clock square-wave, typically having a clock frequency of about 18 Hz. RST shows the reset pulse, and the successive LED-pulsing pulses are shown at Q1 and Q8.

Figure 13:
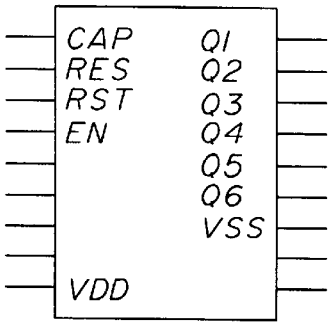
FIG. 13 is a diagram of an integrated circuit device which may be used in the embodiment of FIG. 11.
Figure 9:
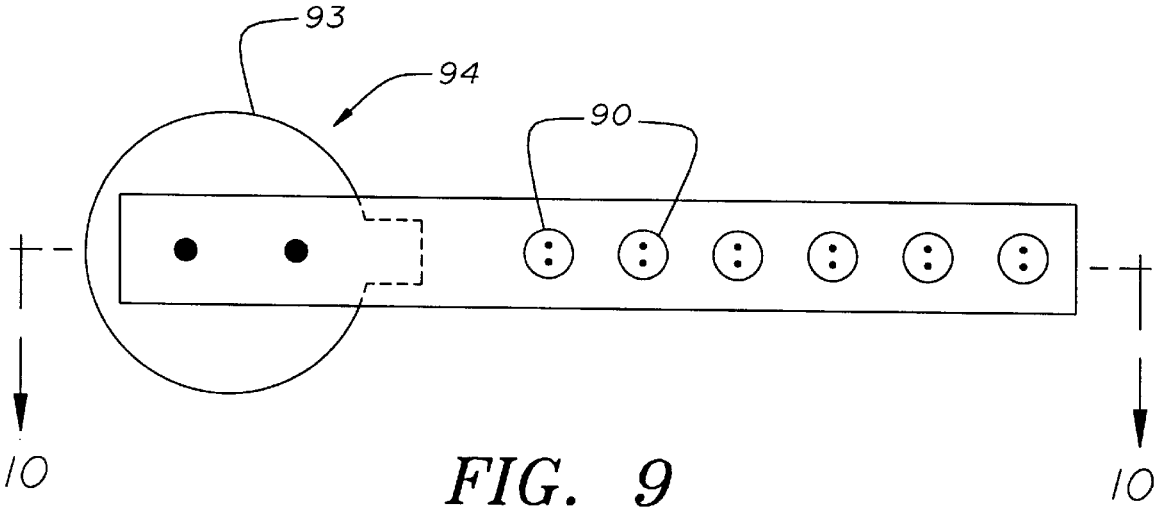
FIG. 9 is a plan view of the embodiment of the invention of FIG. 8, utilizing a series of successively illuminated light-emitting diodes.

FIG. 13 shows the pin arrangement, as does Table I, for the driver IC. The letters EN in FIG. 13 denote a signal that will enable the circuit to run from an internal clock without the need to use the external resistor RES. RST is the reset line, CAP is the pin to be connected to the higher-voltage side of the capacitor, and VDD indicates the battery supply voltage pin. Such a circuit can be used to drive up to 6–10 LED's. The driver is preferably fabricated using CMOS or other low power technology to reduce power consumption. The customized circuitry of this invention can be modified to include one-shot circuitry for time-delayed pulsing, motion sensor controlled output, selectable drive current, and jumper selectable clock frequency, for example.

Figure 14:
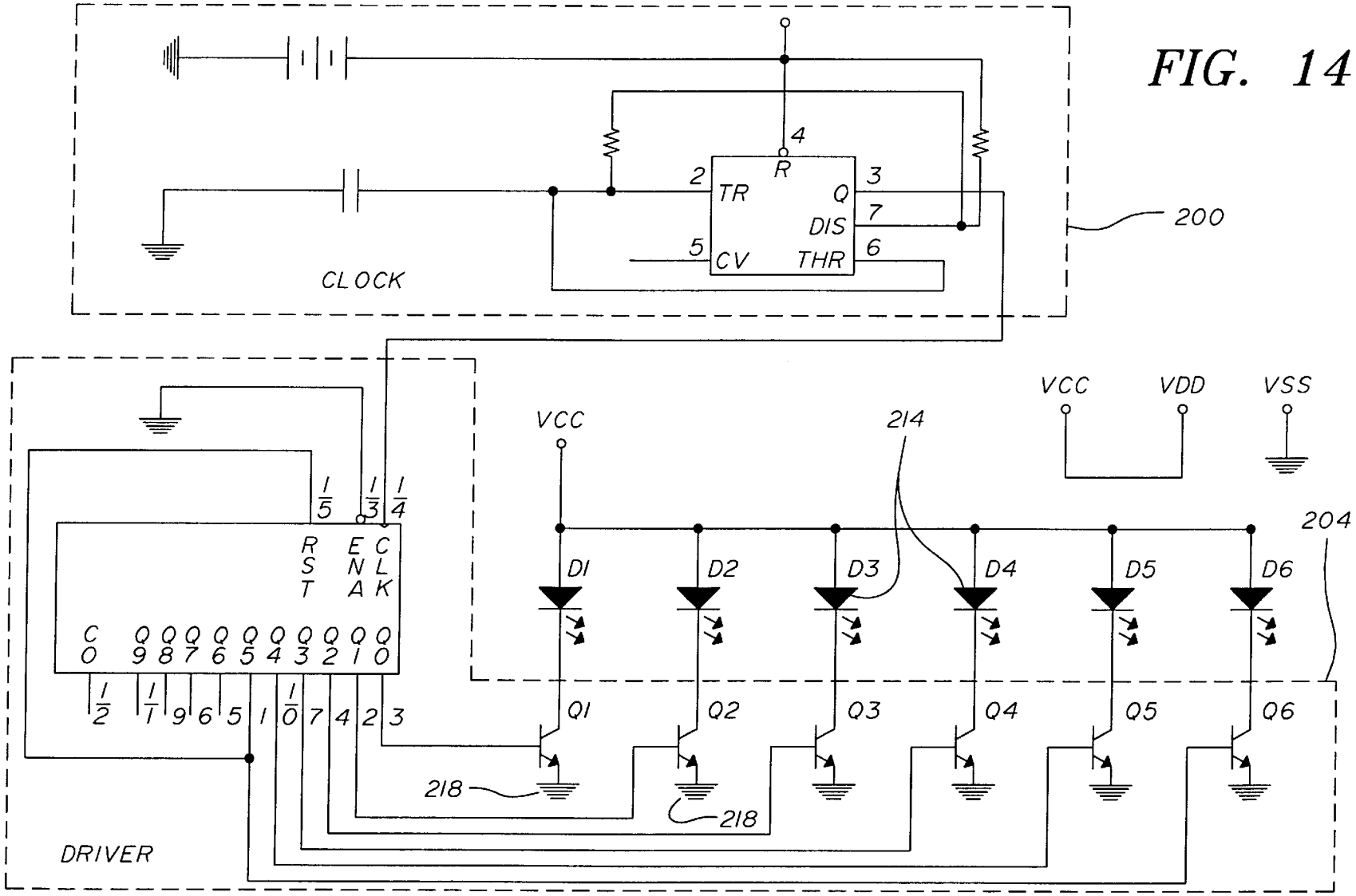
FIG. 14 is a more detailed electrical schematic diagram illustrating a digital clock and digital driver used in one preferred embodiment of the invention to pulse the light-emitting diodes of FIG. 9.

The latter preferred driver circuit is shown in even more detail in FIG. 14, wherein the clock 100 is shown with its IC circuit 202 and its associated resistors and capacitor, used to derive the desired sequential clock pulses. The driver 204 includes the IC circuit 206 which responds to the clock pulses to produce on its output lines, such as 210, separate voltage pulses for turning on respective LED's such as D1 to D6, by way of the emitter-to-collector paths of the respective transistors Q1 to Q6, which are turned on and off by the driver.

In each of the above-described products, a timer may be incorporated to shut off power to the device after a predetermined operation time to conserve battery life. This timer, as well as the power itself, may be actuated by a manual on-off switch activated by the user, a motion switch, photo switch, or similar means.

While the invention has been described with particular reference to specific embodiments in the interest of complete definiteness, it will be understood that it may be embodied in a variety of forms diverse from those specifically shown and described, without departing from the spirit and scope of the invention.

TABLE I

LD IC Pinout

| FUNCTION | NAME | # OF PINS |
|---|---|---|
| LED Driving Outputs | Q1–Q6 | 6 |
| Clock Resistor | RES | 1 |
| Clock Capacitor | CAP | 1 |
| Power | VDD | 1 |
| Ground | VSS | 1 |
| Reset | RST | 1 |
| Internal Clock Enable | EN | 1 |

What is claimed is:

1. An intermittently illuminated article of apparel, comprising:

a light source;

a flasher connected to said light source;

a battery holder connected to said flasher for holding a battery; and support means mountable on the hair of a wearer by an elastic member connected thereto, said support means supporting said light source.

2. The article of claim 1, wherein said flasher further comprises a pulse generator.

3. The article of claim 2, wherein the pulse generator further comprises a digital oscillator for generating sequential pulses of voltage, and means for supplying said pulses of voltage to said light source.

4. The article of claim 1, wherein said support means comprises a ball in which said flasher is mounted, said ball having an interior cavity, said ball further having attachment means for securing said ball to an elastic band.

5. The article of claim 4, wherein said ball is made in two separable and reassemblable sections, to provide ready access to the interior cavity thereof as needed.

6. The article of claim 5, wherein said sections are configured so that they can be snapped together and pulled apart readily.

7. The article of claim 4, wherein said attachment means comprises a passage extending through the ball to receive the elastic band.

8. The article of claim 4, wherein said battery holder is integrated within said ball.

9. The article of claim 4, wherein said battery holder is mounted within said ball.

10. The article of claim 1, wherein said light source further comprises at least one light-emitting diode.

11. An illuminated item of apparel, comprising:

a transparent or translucent outer shell;

a closed elastic loop connected to said shell;

a light source within the shell;

a flasher connected to said light source, said flasher being mounted within said shell; and a battery holder connected to said flasher for holding a battery.

12. The illuminated item of claim 11, wherein said light source is mounted within said shell.

13. The illuminated item of claim 11, wherein said battery holder is mounted within said shell.

14. The illuminated item of claim 11, wherein said battery holder is integrated within said shell.

15. The illuminated item of claim 11, wherein said flasher comprises a switch means for selectively activating said light source.

16. The illuminated item of claim 15, wherein said switch means is manually activated.

17. The illuminated item of claim 15, wherein said switch means comprises a motion sensor.

18. The illuminated item of claim 11, wherein said light source further comprises at least one light-emitting diode.

19. An illuminated item of apparel according to claim 11, wherein the outer shell has a passage therethrough, and the closed elastic loop passes through the passage of the outer shell.

20. An illuminated hair ornament comprising:

a pair of fasteners connected by a thin connecting member, at least one of said fasteners comprising a polymeric shell having a cavity therein, said cavity containing a first light source;

a flasher electrically connected to said light source, said flasher causing said first light source to produce repetitive pulses of light to be emitted from said shell;

and a batter holder connected to said flasher for holding a battery.

21. The hair ornament of claim 20, wherein said thin connecting member comprises an elastic component.

22. The hair ornament of claim 20, wherein said second fastener comprises a polymeric shell and a second light source contained therein.

23. The illuminated hair ornament of claim 20, wherein said first light source further comprises at least one light emitting diode.

24. The illuminated hair ornament of claim 20, wherein said flasher further comprises a timing chip.

25. An illuminated hair ornament comprising:

a pair of translucent polymeric shells connected by an elastic string-like member, said polymeric shells comprising first and second light sources contained therein;

a flasher, said flasher causing said light sources to produce repetitive pulses of light to be emitted from said translucent shells; and a battery holder connected to said flasher for holding a battery.

* * * * *